United States Patent [19]

Krugh

[11] Patent Number: 4,515,212

[45] Date of Patent: May 7, 1985

[54] INTERNAL CASING WIPER FOR AN OIL FIELD WELL BORE HOLE

[75] Inventor: Michael E. Krugh, Casper, Wyo.

[73] Assignee: Marathon Oil Company, Findlay, Ohio

[21] Appl. No.: 459,566

[22] Filed: Jan. 20, 1983

[51] Int. Cl.[3] ..... E21B 31/03; E21B 31/06; E21B 31/08

[52] U.S. Cl. ..... 166/99; 166/170

[58] Field of Search ..... 166/99, 170, 173, 162, 166/165; 175/308, 312

[56] References Cited

U.S. PATENT DOCUMENTS

| | | | |
|---|---|---|---|
| 1,520,803 | 12/1924 | Brown | 166/99 |
| 1,666,000 | 4/1928 | Campbell | 166/174 |
| 2,157,493 | 5/1939 | Miller et al. | 166/174 |
| 2,556,849 | 6/1951 | Nelley et al. | 166/99 |
| 2,617,486 | 11/1952 | Davis | 166/99 |
| 2,645,290 | 7/1953 | Fortenberry | 166/19 |
| 2,687,913 | 8/1954 | Baker | 294/86 |
| 2,717,650 | 9/1955 | Hall, Sr. | 166/241 |
| 2,890,756 | 6/1959 | Middleton | 166/99 |
| 2,916,091 | 12/1959 | Caudill | 166/103 |
| 3,023,810 | 3/1962 | Anderson | 166/99 |
| 3,382,925 | 5/1968 | Jennings | 166/99 |
| 3,500,933 | 3/1970 | Burba, Jr. et al. | 166/311 |
| 3,651,867 | 3/1972 | Baumstimler | 166/99 |
| 3,814,180 | 6/1974 | Oliver | 166/99 |
| 4,059,155 | 11/1977 | Greer | 166/99 |
| 4,189,000 | 2/1980 | Best | 166/173 |
| 4,332,296 | 6/1982 | Wayt | 166/171 |

OTHER PUBLICATIONS

Fishing Tools and Techniques by Petroleum Extension Service, p. 21.

Tri-State General Catalog by Tri-State Oil Tool Industries, Inc., 1980-1981, pp. 38-39.

Oilfield Services and Manufactured Products by HOMCO, 1982-1983 Catalog, pp. 8-9.

Bowen Fishing Magnets by Bowen, Sep., 1981, pp. 2-3.

Itco Type Bowen Junk Baskets by Bowen, May, 1981, pp. 2-3.

Bowen Reverse Circulation Junk Baskets, May, 1980, pp. 1-3.

Data Handbook by SERVCO Division of Smith International, Inc., pp. 2-4.

*Primary Examiner*—William F. Pate, III

*Attorney, Agent, or Firm*—Rodney F. Brown; Jack L. Hummel

[57] ABSTRACT

The invention provides for an improved internal casing wiper tool 10 designed to wipe the casing sides 10 of a well bore hole 30 in order to remove debris 60 contained thereon and further to remove debris 60 contained in fluid found in the bore hole 30. The tool of the present invention includes a first chamber 210 for collecting larger sized pieces 430 of debris 60 and a second chamber 300 for collecting the smaller sized pieces 440 of debris 60 as the tool is lowered into the well bore hole 30. The tool includes an elongated pipe 100 having its upper end 310 connected to the lower end 350 of the drilling string 20 internally containing the first 210 and second 300 chambers, a plurality of centralizers 130 are disclosed around the tube 100 for substantially centering the tube 100 in the bore hole, a petal basket 110 is connected to the lower end 102 of the pipe having a plurality of outwardly extending petals 120 around its periphery for wiping the casing sides in order to dislodge the debris and to guide the fluid with the debris into the tube 100, a first filter 160 is located at a first predetermined distance 150 from the lower end 102 of the pipe 100 and separates out the larger pieces 430 of debris 60 and a second filter 230 is located above the first filter for separating out the smaller pieces 440 of debris 60, a check valve 320 is located above the second filter 230 and permits the cleaned fluid to flow outwardly from the tool 10 back into the well bore 30.

3 Claims, 6 Drawing Figures

Fig. 2
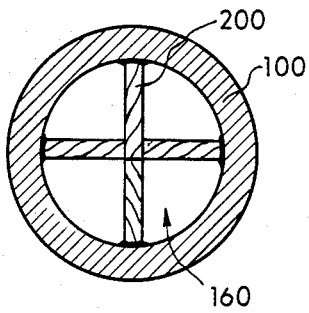
Fig. 3
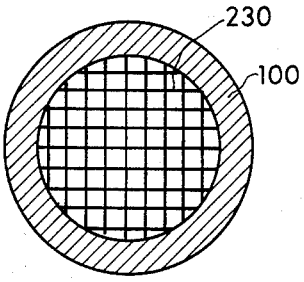
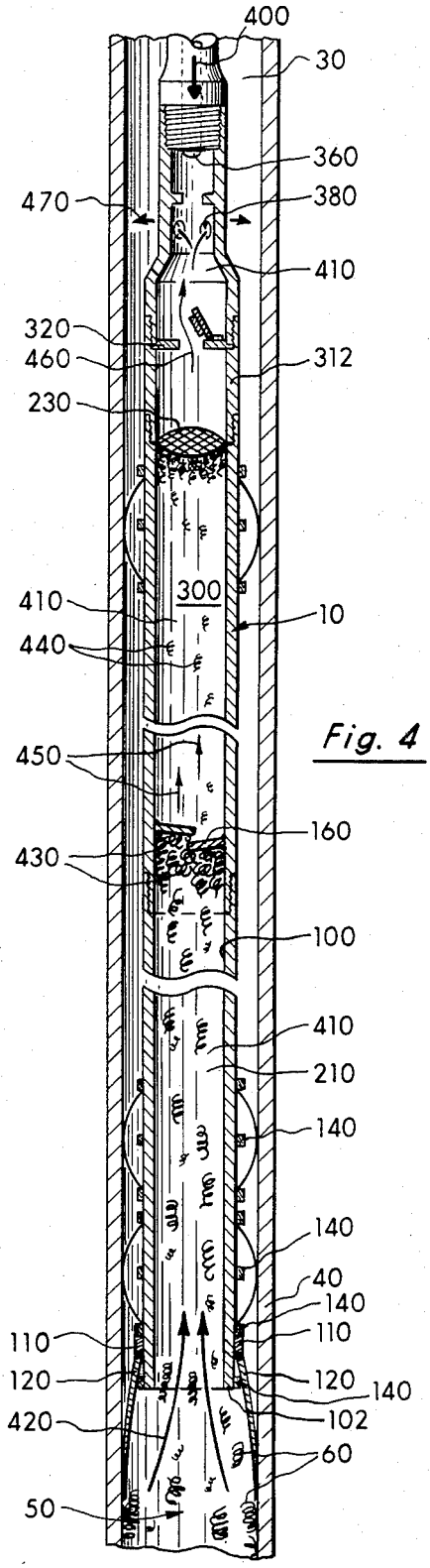
Fig. 4

INTERNAL CASING WIPER FOR AN OIL FIELD WELL BORE HOLE

TECHNICAL FIELD

The present invention relates to an internal casing wiper for removing debris and other material in a cased well bore hole and, more particularly, to an internal casing wiper for use in a cased oil field well bore hole connectable to a drill string.

BACKGROUND OF ART

A variety of different types of debris known as "junk" can accumulate in a conventional oil well bore hole. Such "junk" includes metallic shavings, chips, twists, or curls dispersed throughout the length of the bore hole and which may adhere to the casing wall by natural magnetism. Such debris can also include portions of expendable tools, broken tools, or other tool items left in the well as well as any other foreign matter which may have fallen into the well. For example, when a portion of a casing is cut or milled in order to provide an offshoot from the bore hole, a considerable amount of cuttings are generated varying in length from several feet to several inches or less. It is roughly estimated that, in certain cases, for every five feet of casing milled approximately a barrel of cuttings are generated. In another situation, aluminum stripping bands are used to tie down electric cables in down hole electric pumps. These strapping bands can break and accumulate in the bore hole. The present invention is designed to primarily retrieve the type of junk described in the aforesaid two examples although it can also be used to retrieve other forms of conventional junk.

A number of conventional approaches exist for removing debris from the oil well bore hole such as the circulation of drilling mud to carry upwardly and outwardly from the well bore hole the smaller items of debris, the use of magnets to attract the metallic items and various other types of fishing equipment.

As a result of a patentability search conducted for the present invention, the following prior art patented approaches were uncovered:

| INVENTOR | U.S. PAT. NO. | DATE ISSUED |
|---|---|---|
| Fortenberry | 2,645,290 | July 14, 1953 |
| Baker | 2,687,913 | Aug. 31, 1954 |
| Hall, Sr. | 2,717,650 | Sept. 13, 1955 |
| Caudill | 2,916,091 | Dec. 8, 1959 |
| Anderson | 3,023,810 | March 6, 1962 |
| Jennings | 3,382,925 | May 14, 1968 |
| Burba, Jr. | 3,500,933 | March 17, 1970 |
| Baumstimler | 3,651,867 | March 28, 1972 |
| Oliver | 3,814,180 | June 4, 1974 |
| Best | 4,189,000 | Feb. 19, 1980 |
| Wayt | 4,332,296 | June 1, 1982 |

The 1970 patent to Burba, Jr. et al (U.S. Pat. No. 3,500,933 sets forth an apparatus for removing debris which includes a positive action wiper in the form of molded rubber cups for actually scraping the sides of the casing as the apparatus is moved downwardly into the oil well bore hole. As the Burba, Jr. et al apparatus is moved downwardly, the drilling mud is forced through the center of the tool and upwardly through an internal flow member, through a flapper valve and thence into an area of greater diameter which effectuates a separation of the heavier particles from the flow of the mud which are then caught in an entrapment chamber. As the tool is pulled upwardly, the flapper valve closes and the elongated slots on the side of the entrapment chamber allow the mud to flow freely therethrough while retaining the debris.

In the 1968 Jennings (U.S. Pat. No. 3,382,925), the 1974 Oliver (U.S. Pat. No. 3,814,180), and the 1962 Anderson (U.S. Pat. No. 3,023,810) patents, outwardly jetting fluid is utilized to dislodge debris accumulated on the walls of the casing. In these approaches, the outwardly jetting fluid provides the wiping action. The fluid is inputted from the drilling string and then is typically jetted outwardly around the periphery of the tool. In each of these approaches, a trap or chamber is provided for containing the collected debris. In the Anderson approach, a lower trap 25 is utilized to collect and contain the larger debris and a smaller trap 32 is utilized to entrap and contain the smaller debris. In these approaches the possibility exists that debris will be bypassed by the cleaning tool since the tool does not abut or actually scrape the sidewalls of the casing. In that event, debris can actually ball-up behind the tool and prevent removal of the tool from the bore hole.

The 1953 patent to Fortenberry (U.S. Pat. No. 2,645,290) also discloses a "junk" basket having a lower chamber for entrapping larger pieces of debris and an upper chamber for entrapping smaller pieces of debris. Fortenberry generates an upwardly directed high velocity jet for inducing a secondary circulation in the tool to cause the collected junk to move readily into the junk basket. Hence, Fortenberry is designed to be utilized while circulating the drilling fluid. As in the three above described patented approaches, Fortenberry also utilizes cutting teeth at the bottom of the tool in an effort to reduce the size of the larger pieces of debris to smaller pieces.

The 1954 patent to Baker (U.S. Pat. No. 2,687,913) also sets forth a tool for collecting and entrapping larger sized pieces of debris in a lower portion and smaller sized pieces of debris in an upper portion of the tool. Like the teachings of Burba, Jr. et al, Baker is designed to work in a static fluid environment (i.e., drilling fluid or other types of fluid are not pumped down into the tool to create various jets). As the tool is dropped, the Baker junk catcher is spring loaded so that when debris is encountered, the tool opens to collect the debris. When collected, the tool closes and can be lifted upwardly to remove debris.

The remaining patents uncovered in the search set forth various structural forms of well cleaning tools or casing scrapers embodying structural approaches which are not as close to the present invention as those disclosed in the above references.

Of all of the above prior patented art approaches, only the Baker and the Burba, Jr. patents, are relevant to the teachings of the applicant's invention by operating in a static fluid environment without the introduction of drilling fluid to create a jetting action. One disadvantage with the Burba, Jr. approach is the consumption of the wiper cups which, made of rubber, must be replaced after use. Furthermore, the wearing of the rubber cups causes rubber to be placed into the bore hole and rubber debris is difficult to retrieve. Additionally, Burba does not scrape or wipe at a point at or near the end of the tool and milled cuttings can ball up and nest between the rubber cup and the end of the tool possibly causing the tool to stick. And finally, Burba must permit junk to flow through a valve 80 before separation occurs. Such an arrangement may cause the clogging of the valve by large pieces of junk or by the capture of milled curlings. The disadvantage inherent in the Baker approach resides in the fact that actual wiping or scraping action against the casing wall does not occur. The possibility exists in Baker that debris clinging to the sides of the casing will be bypassed and, as previously discussed, ball-up behind the tool.

DISCLOSURE OF INVENTION

The problem faced in designing an internal casing wiper for a well bore hole is to design a low cost tool that is simple in design and which can be fabricated from conventionally available parts. Furthermore, it is desired to design such a tool that can be used in a static environment with no fluids flowing and which will thoroughly wipe the sides of the casing and to prevent the possibility of debris accumulating behind the tool while retrieving cuttings and the like.

The internal casing wiper tool of the present invention provides a solution to the problem and includes an elongated pipe having a first collection chamber and a second collection chamber disposed therein, and a petal basket located at its lower end for wiping the sides of the casing as the tool travels downwardly and for directing the fluid containing the debris to an internal passageway and through a first filter or trap where larger pieces of debris are separated and collected in the first chamber and upwardly through a second filter where the smaller pieces of debris are separated out from the fluid and collected in the second chamber. The cleaned fluid then is delivered through a check valve located below the cross-over joint at the upper end of the tube and out through a plurality of formed ports back into the well bore hole. In this fashion, all of the fluid in the well bore hole is filtered and debris found on the walls of the casing is removed. A drill pipe float is further provided at the end of the drill string to prevent any of the fluids from entering into the drill string. Finally, a plurality of centralizers disposed around the outer periphery of the pipe support the tool substantially in the center of the bore hole.

In comparison to the conventional prior art approaches, the present invention provides a simple design made from conventional parts for thoroughly cleaning the fluid in a well bore hole by scraping and wiping the casing sides free of debris while maintaining the fluid in a substantially static environment (i.e., without the injection of additional fluids). Furthermore, the scraping or wiping action occurs at the end of the tool to minimize the balling or nesting of cuttings. Finally, the dual filtering action of the present invention does not permit junk to pass through the operating valves.

BRIEF DESCRIPTION OF THE DRAWINGS

The details of the present invention are described in the accompanying drawings.

FIG. 2 is a sectional view on the line 2—2 of FIG. 1 illustrating in more detail the structure of the first filter;

FIG. 3 is a sectional view on the line 3—3 of FIG. 1 illustrating in more detail the structural arrangement of the second filter;

FIG. 4 is a vertical sectional view illustrating the flow of the fluid with debris through the tool and the wiping action of the tool on the casing;

BEST MODE FOR CARRYING OUT THE INVENTION

Figure 1:
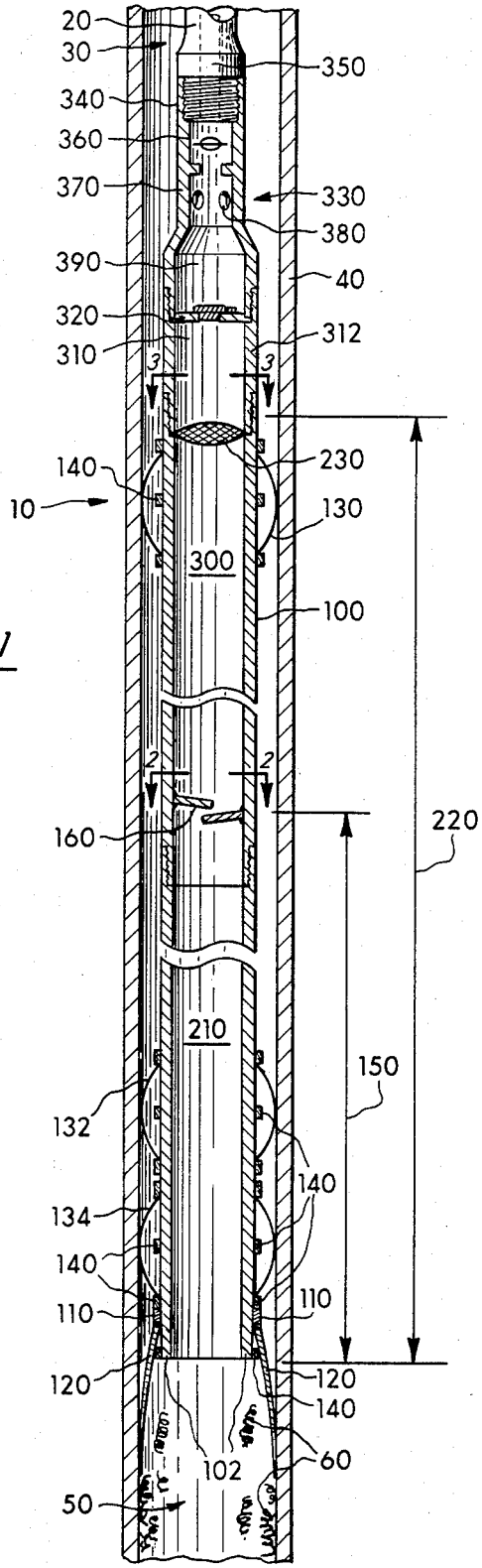
FIG. 1 is a vertical sectional view illustrating the present invention secured to the lower end of a drill string in a well bore hole.

In FIG. 1, the internal casing wiper tool 10 of the present invention is affixed to a conventional drill string 20 and is disposed in a well bore hole 30 having a standard casing 40 disposed therein. The well bore hole contains fluid 50 and debris 60. Some of the debris 60 clings to the sides of the casing 40 and some is actually disposed in the fluid 50. It is the function of the tool 10 of the present invention to be connected to the drill string 20 and to be lowered into the well bore hole 30 to wipe the debris 60 from the casing wall and to clean the debris 60 from the fluid and then to collect the debris 60 and store it internally in the tool.

The tool 10 of the present invention includes an elongated tube 100 having connected to its lower end 102 a conventionally available metal petal basket 110 having outwardly extending petals 120 for scraping or wiping the casing 40 to remove any debris magnetically clinging thereto. The metal petal basket 110 also serves to guide or funnel the fluid into the tube as will be subsequently described. Such baskets are typically used in a cementing process for cementing well casings and endure well in an abrasive environment. In the preferred embodiment, the basket 110 is a conventional cement metal petal basket, with metal strapping reinforcement provided thereto of the type manufactured by Bakerline, Division of Baker International, Inc., 6110 Rittiman Road, P.O. Box 18628, San Antonio, Tex. 78218; Product No. 231-01. The basket 110 conventionally engages the elongated tube 100 by means of an upper and lower stop ring 140.

The petals 120 are held outwardly against and firmly abut the casing 40 by the pressure of the fluid 50 on petals 120 in order to firmly engage the casing and to provide the wiping or scraping action necessary under the teachings of the present invention. A plurality of centralizers 130, 132, 134 are disposed at various locations along the elongated tube 100 in order to support the tube substantially in the center of the well bore hole 30. In the preferred embodiment, two of the centralizers 132 and 134 are located near the lower end 102 of the tube 100 in order to stabilize the end as it is wiping the casing 40. The centralizers are conventionally available from: Halliburton Services, 1015 BoisD'arc Street, P.O. Drawer No. 1431, Duncan, Okla. 73533; Model No. S-3. Stop rings 140 are used to hold centralizers 130, 132, and 134 in position.

In the preferred embodiment two or more lengths of conventional seven inch in diameter casing pipes are joined together. Each section is 38 to 45 feet long and two to three sections may be utilized. It is to be expressly understood that the diameter of the tube is a function of the diameter of the casing and, in the preferred embodiment, a seven inch diameter for the tube is designed to operate with a nine and five/eighths inch casing for the well bore hole 30.

Located a first predetermined distance 150 away from the lower end 102 of the pipe 100 is a first filter or trap 160 which, as shown in FIG. 2, is comprised of a number of several lengths of cable 200 which are welded inside the tube 100. The plurality of cable lengths 200 act to trap the larger pieces of debris or junk and to collect those pieces in a first chamber 210 as shown in FIG. 1. The first chamber 210 begins at end 102 and extends upwardly through the tube 100 to the location of the filter 160 the entire predetermined distance 150.

Located a second predetermined distance 220 above the lower end 102 is a second filter 230 which is composed of a wire screen mesh, a slotted steel plate, or a perforated plate. In the preferred embodiment shown in FIG. 3, the second filter 230 is made of sturdy quarter inch mesh wire screen. A second chamber 300 is formed between the first filter 160 and the second filter 230 and serves to collect the smaller pieces of debris as well be subsequently set forth. At the upper end 310, of the pipe 100, a standard check valve 320 is inserted between one casing pipe and a small casing pipe section 312 of about five feet in length. The check valve 320 functions to permit the fluid 50 to flow upwardly through passageway 410. The check valve is conventionally available from: Davis-Lynch, Inc., Box 12326, Houston, Tex. 77017; Type 904F.

Figure 6:
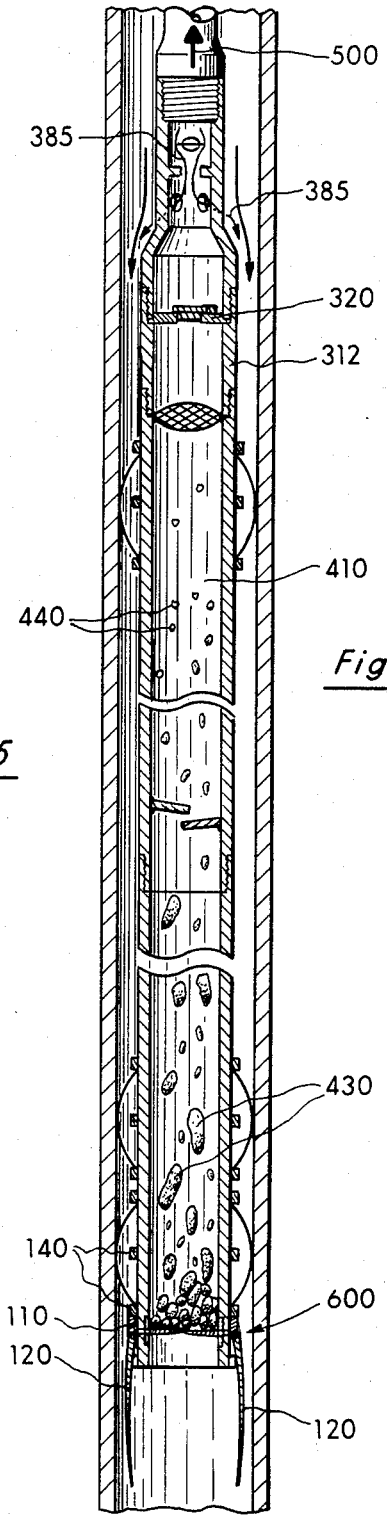
FIG. 6 is a vertical sectional view illustrating an alternate embodiment of the present invention retrieving debris from a well bore hole.

A cross-over joint 330 is affixed to the check valve 320 at the upper end 310 of the pipe 100. The cross-over joint 330 essentially adapts the diameter of the pipe 100 to the smaller diameter of the drilling string 20 and, therefore, the upper end 340 of the cross-over joint 330 is connected to the lower end 350 of the drill string 20 in a conventional fashion. The cross-over joint 330 includes an inserted standard drill pipe float 360, a mid-section region 370 having a plurality of formed ports 380 and an enlarged section 390 for engagement above the check valve 320. The formed ports 380 function to allow the fluid 50 to flow out from the tool into the bore hole. The drill pipe float 360 functions to prevent any fluid such as drilling mud from entering into the drill string 20 and is conventionally available from: Baker-line, Division of Baker International, Inc., 6110 Rittiman Road, P.O. Box 18628, San Antonio, Tex. 78218; Model F, No. 480-13. As the total is lowered into the wellbore, the use of the drill pipe float 360 necessitates the filling of the drill string 20 from the surface as is commonly done. As the tool is pulled from the hole, the fluid in the drill string 20, as shown in FIG. 6 by arrows 385, will drain itself through the float 360 and out the ports 380 into the annular area outside the drill string 20.

Figure 5:
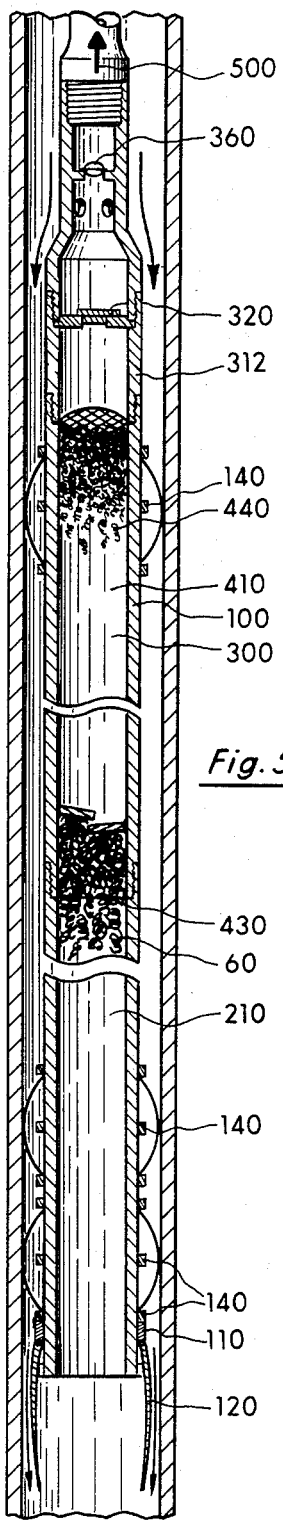
FIG. 5 is a vertical sectional view illustrating the present invention retrieving debris from a well bore hole.

The operation of the present invention is set forth in FIGS. 4 and 5. In FIG. 4, the tool 10 of the present invention is lowered downwardly in the bore hole 30 in the direction of arrow 400. As mentioned, the bore hole 30 contains fluid 50, such as drilling mud, with debris 60 such as milled curlings. As the tool 10 travels downwardly in the direction of arrow 400, the petals 120 of the metal basket 110 under pressure fluid 50 wipe or scrape the sidewalls of the casing 40 to clean the debris clinging on the sidewalls and to guide the fluid 50 and debris 60 upwardly into a passageway 410 of the tube 100. The upward flow of the fluid as depicted by arrows 420 cause the larger pieces 430 of the debris 60 to separate at filter 160 while permitting the fluid containing the smaller pieces of debris 440 to flow upwardly into the second chamber 210. Hence, the larger pieces 430 of the debris are snagged and become nested and, hence, collected in lower chamber 300. When this occurs, and especially in the case of milled curlings, the nested debris also contributes to the filtering or entrapment action. As the fluid 50 with the smaller pieces 440 of debris 60 move upwardly in the passageway 410 the smaller pieces of debris 440 are separated out from the fluid at the second filter 230 and are collected in the second chamber 300, as shown by arrows 450. The fluid then flows, free of junk except for minute sized pieces, as shown by arrow 460 through the check valve 320 which opens to permit the upward flow of the fluid 50 and outwardly through ports 380 in the directions of arrows 470 and back into the well bore hole 30. At this point, the fluid is cleaned and essentially remains static in the well bore.

In this fashion, the tool 10 of the present invention wipes the casing 40 and entraps the larger pieces 430 of debris 60 in the first chamber 210 and the smaller pieces 440 of the debris 60 in a second chamber 300.

As shown in FIG. 5, once the tool has been run in the well to the desired depth and the casing has been wiped, the tool is simply pulled back out of the hole causing the check valve 320 to close and to trap the larger pieces 430 of the debris 60 in the first chamber 210 and the smaller pieces 440 of debris 60 in the second chamber 300 under a static pressure created inside tube 100 and due to the nesting of the debris. The metal petals 120 relax to a vertical position due to the change of fluid pressure on the petals, the fluid pressure being caused by the movement of the tool being pulled out of the hole. In some circumstances, it may be desirable to forcibly bend the petals 120 into the bottom end 102 of the casing to further assure that all entrapped debris will be pulled upwardly and out of the bore hole.

In FIG. 6 an alternate embodiment to the present invention is shown incorporating a conventional finger basket 600 which operates to close as the tool is lifted up and opens as the tool is lowered. In the situation where the debris in the bore hole does not nest near the filters, a finger basket can be conventionally used to close off the lower end of the tool to allow retrieval of the junk.

Although the internal casing wiper of the present invention has been set forth in a preferred embodiment it is expressly understood that changes or modifications may be made to accommodate different sized casings and different length chambers without departing from the spirit or teachings of the present invention as set forth in the following claims.

I claim:

1. An improved internal casing wiper tool connected to a drill string (20) for wiping the casing sides (40) of a well bore hole (30) to remove debris (60) contained thereon, said bore hole (30) having fluid (50) with debris (60) contained therein, said tool being capable of collecting larger sized pieces (430) of debris in a first chamber (210) and collecting smaller sized pieces (440) of debris in a second collection chamber (300) as said drill string (20) is lowered into said well bore hole, said improved tool comprising:

a crossover joint (330) having one end (340) connected to the lower end (350) of the drill string (20) and having a formed internal fluid passageway (410), said crossover joint comprising:

(a) a drill pipe float (360) inserted in said passageway (410) and contacting said lower end (350) for preventing said fluid (50) from entering said drill string (20), and (b) a plurality of formed ports (380) around the mid-section (370) of said crossover joint (330) to allow fluid (50) to flow out from said passageway (410), a check valve (320) contacting said crossover joint located in said passageway (410) below said plurality of formed ports (380) for permitting the flow of fluid upwardly through said passageway (410) into said ports (380), said check valve (320) being capable of preventing the flow of said fluid (50) downwardly in said passageway (410), an elongated pipe (100) having its upper end (310) connected to the second end (390) of said crossover joint (330) for extending said fluid passageway (410), a plurality of centralizers (130) disposed around the outer periphery of said pipe (100) for supporting said pipe substantially in the center of said bore hole (30), a petal basket (110) connected to the lower end (102) of said pipe (100) having a plurality of outwardly extending petals (120) around its periphery, said petals (120) under pressure of said fluid (50) being capable of abutting and wiping said casing sides (30) to dislodge said debris (160), a first filter (60) located a first predetermined distance (150) from said lower end (102) of said pipe (100) for collecting said larger pieces (430) of debris (60) in a first chamber (210) located in said pipe (100) between said first filter (160) and said petal basket (110), and a second filter (230) located a second predetermined distance (220) from said lower end (102) of said pipe (100) for collecting said smaller pieces (440) of debris (60) in a second chamber (300) located in said pipe (100) between said first filter (160) and said second filter (230) so that as said tool is lowered in said well bore hole (30) said fluid (50) is entrained upwardly into said passageway (410) through said first filter (160), through said second filter (230), through said check valve (320) and out said ports (380) and back into said well bore hole (30), said larger pieces (430) of debris (60) in said fluid (50) being collected in said first chamber (210) and said smaller pieces (440) of debris (60) being collected in said second chamber (300).

2. An improved internal casing wiper tool connected to a drill string (20) for wiping the casing sides (40) of a well bore hole (30) to remove debris (60) contained thereon, said bore hole (30) having fluid (50) with debris (60) contained therein, said tool being capable of collecting larger sized pieces (430) of debris in a first chamber (210) and collecting smaller sized pieces (440) of debris in a second collection chamber (300) as said drill string (20) is lowered into said well bore hole, said improved tool comprising:

means (330) for connection to the lower end (350) of said drill string (20), said connecting means having a formed internal fluid passageway (410) therein and further comprising:

(a) means (360) inserted in said passageway (410) and connected to said lower end (350) of said drill string (20) for preventing said fluid (50) from entering said drill string (20), and (b) means (380) around the mid-section (370) of said crossover joint (330) for allowing fluid (50) to flow out from said passageway (410), means (320) contacting said connecting means located in said passageway (410) below said allowing means (380) for permitting the flow of fluid upwardly through said passageway (410) into said allowing means (380), said permitting means (320) being capable of preventing the flow of said fluid (50) downwardly in said passageway (410), an elongated pipe (100) having its upper end (310) connected to the second end (390) of said connecting means (330) for extending said fluid passageway (410), means (130) disposed around the outer periphery of said pipe (100) for supporting said pipe substantially in the center of said bore hole (30), means (110) connected to the lower end (1020 of said pipe (100) for abutting and wiping said casing sides (30) to dislodge said debris (60), a first filter (160) located a first predetermined distance (150) from said lower end (102) of said pipe (100) for collecting said larger pieces (430) of debris (60) in a first chamber (210) located in said pipe (100) between said first filter (160) and said wiping means (110), and a second filter (230) located a second predetermined distance (220) from said lower end (102) of said pipe (100) for collecting said smaller pieces (440) of debris (60) in a second chamber (300) located in said pipe (100) between said first filter (160) and said second filter (230) so that as said tool is lowered in said well bore hole (30) said fluid (50) is entrained upwardly into said passageway (410) through said first filter (160), through said second filter (230), through said permitting means (320) and out said allowing means (380) and back into said well bore hole (30), said larger pieces (430) of debris (60) in said fluid (50) being collected in said first chamber (210) and said smaller pieces (440) of debris (60) being collected in said second chamber (300).

3. An improved internal casing wiper tool connected to a drill string (20) for wiping the casing sides (40) of a well bore hole (30) to remove debris (60) contained thereon, said bore hole (30) having fluid (50) with debris (60) contained therein, said tool being capable of collecting larger sized pieces (430) of debris in a first chamber (210) and collecting smaller sized pieces (440) of debris in a second collection chamber (300) as said drill string (20) is lowered into said well bore hole, said improved tool comprising:

a crossover joint (330) having one end (340) connected to the lower end (350) of the drill string (20) and having a formed internal fluid passageway (410), said crossover joint comprising:

(a) a drill pipe float (360) inserted in said passageway (410) and contacting said lower end (350) for preventing said fluid (50) from entering said drill string (20), and (b) a plurality of formed ports (380) around the mid-section (370) of said crossover joint (330) to allow fluid (50) to flow out from said passageway (410), a check valve (320) contacting said crossover joint located in said passageway (410) below said plurality of formed ports (380) for permitting the flow of fluid upwardly through said passageway (410) into said ports (380), said check valve (320) being capable of preventing the flow of said fluid (50) downwardly in said passageway (410), an elongated pipe (100) having its upper end (310) connected to the second end (390) of said crossover joint (330) for extending said fluid passageway (410), a petal basket (110) connected to the lower end (102) of said pipe (100) having a plurality of outwardly extending petals (120) around its periphery, said petals (120) under pressure of said fluid (50) being capable of abutting and wiping said casing sides (30) to dislodge said debris (60), a first filter (160) located a first predetermined distance (150) from said lower end (102) of said pipe (100) for collecting said larger pieces (430) of debris (60) in a first chamber (210) located in said pipe (100) between said first filter (160) and said petal basket (110), and a second filter (230) located a second predetermined distance (220) from said lower end (102) of said pipe (100) for collecting said smaller pieces (440) of debris (60) in a second chamber (300) located in said pipe (100) between said first filter (160) and said second filter (230) so that as said tool is lowered in said well bore hole (30) said fluid (50) is entrained upwardly into said passageway (410) through said first filter (160), through said second filter (230), through said check valve (320) and out said ports (380) and back into side well bore hole (30), said larger pieces (430) of debris (60) in said fluid (50) being collected in said first chamber (210) and said smaller pieces (440) of debris (60) being collected in second chamber (300).

* * * * *